US006241404B1

(12) United States Patent
Fietze et al.

(10) Patent No.: US 6,241,404 B1
(45) Date of Patent: Jun. 5, 2001

(54) METHOD FOR CONTROLLING THE FLOW OF PAPER OBJECTS IN A PAPER PROCESSING SYSTEM

(75) Inventors: Roman Fietze, Kirchheim-Teck; Gerhard Glemser, Stuttgart, both of (DE); Russell Godshalk, Hilton; Allen Heberling, Penfield, both of NY (US); Dirk Langebrake, Bohmte; Albrecht Proebstle, Beuren, both of (DE)

(73) Assignee: Nex Press Solutions LLC, Rochester, NY (US)

( * ) Notice: Subject to any disclaimer, the term of this patent is extended or adjusted under 35 U.S.C. 154(b) by 0 days.

(21) Appl. No.: 09/405,833

(22) Filed: Sep. 30, 1999

(30) Foreign Application Priority Data

Sep. 30, 1998 (DE) ..... 198 44 859

(51) Int. Cl.[7] ..... B41J 11/44

(52) U.S. Cl. ..... 400/76; 400/76; 400/70; 400/61; 399/76

(58) Field of Search ..... 400/76, 70, 61; 399/76, 77; 358/296

(56) References Cited

U.S. PATENT DOCUMENTS 5,363,175 * 11/1994 Matysek ..... 355/208
5,559,606 * 9/1996 Webster et al. ..... 358/296
5,629,775 * 5/1997 Plattetter et al. ..... 358/296
5,668,942 * 9/1997 Fromherz ..... 395/112
5,710,635 * 1/1998 Webster et al. .
6,085,050 * 7/2000 Rowe et al. ..... 399/75
6,122,462 * 9/2000 Hintler ..... 399/77
6,130,999 * 10/2000 Serizawa et al. ..... 399/8

* cited by examiner

*Primary Examiner*—John S. Hilten
*Assistant Examiner*—Charles H. Nolan, Jr.
(74) *Attorney, Agent, or Firm*—James D. Leimbach

(57) ABSTRACT

A method for controlling the flow of paper objects in a paper processing system (PPS), having a main copier and/or printer unit with an output accessory manager (OAM) and at least one paper object processing device ($POPD_1$, $POPD_2$, . . . $POPD_n$). The method is carried out by the following steps:

generating a paper object header (POH) for each paper object (PO) in the output accessory manager (OAM);

sending the paper object header (POH) to downstream paper object processing devices (POPDs) prior to the arrival of a paper object (PO) at the specific paper object processing device (POPD), wherein the paper object header (POH) is updated and modified by each paper object processing device (POPD);

absorbing the paper object header (POH) in the last paper object processing device (POPD) in the route and generating in the last paper object processing device (POPD) a paper object header response (POHR) and sending the paper object header response (POHR) to the output accessory manager (OAM).

13 Claims, 7 Drawing Sheets

METHOD FOR CONTROLLING THE FLOW OF PAPER OBJECTS IN A PAPER PROCESSING SYSTEM

FIELD OF THE INVENTION

The invention relates to a method for controlling the flow of paper objects in a paper processing system having a main copier and/or printer unit with an output accessory manager and at least one paper object processing device.

BACKGROUND OF THE INVENTION

Known paper processing systems consist of a main copier and/or printer unit to which numerous accessory devices are attached. The paper object processing devices of a paper processing system are for example an inserter, a folder, a collator, a stapler unit, an output hopper, a pamphlet maker, a cutter, a large capacity receiver, a binder or a puncher. The control and monitoring of each single device has to be guaranteed in order to ensure efficient usage and productive processing of paper objects with the system. It is therefore necessary that the system be monitored with respect to the capacity and/or the processing abilities of each accessory device.

A method for handling several jobs in an electronic printer is disclosed in EP-A-0 478 341. A printer, with at least two sheets of paper in the queue, comprises a controller which calculates the time necessary for terminating the processing of the first sheet of paper. A time delay for the following sheet of paper is calculated with respect to the necessary time of the previous sheet in the stapler, binder or folder unit. The control signals of the system are guided to corresponding circuits in the various accessory units, which are connected by a local bus system. Additionally, software with an algorithm is used which calculates the time delay between each of the jobs in order to achieve an optimum of productivity.

Published European patent application EP-A-0 571 194 discloses a printer with an attachable sorter unit. The sorter unit has a sensor which senses the flow of a printed sheet of paper. Additionally, the sorter unit possesses a controller which sends data about the state of the sorter unit to the central processing unit in the printer. The printing speed is adjusted in response to the data, or in case of a jam the producing of printed sheets is terminated.

Published European patent application EP-A2-0 627 671 discloses a universal interface for operatively connecting and feeding the sequential copy sheet output of various reproduction machines of widely varying ranges of sheet output level heights to various independent copy sheet processing units.

Published European patent application EP-A2-0 778 523 discloses a method of operation of an image processing apparatus having a controller and a plurality of resources arranged in an arbitrary configuration. Each of the resources provides an associated processor storing data related to operational capabilities of the associated resource. The controller is adapted to dynamically configure the image processing apparatus to operate in accordance with the operational capabilities of each of the processors by defining job requirements as a combination of images defining a set of sheets and specifying compilations of sheets.

SUMMARY OF THE INVENTION

It is the object of the present invention to realize a method for controlling the flow of paper objects through a paper processing system wherein the productivity of the paper processing system is enhanced, the system is better adjustable to the overall configuration and achieves a wide variety of applications.

In accordance with the present invention, this object is attained by a method comprising the following steps:

- generating a paper object header for a paper object in the output accessory manager;
- sending the paper object header to one of plural downstream paper object processing devices prior to the arrival of a paper object at the one paper object processing device, wherein the paper object header is updated and modified and sent to another of the plural paper object processing devices along a route;
- absorbing the paper object header in a last paper object processing device of the plural paper object processing devices in the route and generating in the last paper object processing device a paper object header response and sending the paper object header response to the output accessory manager;
- repeating the above steps for other paper objects in a current job;
- generating a paper object coming in the output accessory manager and sending the paper object coming to the one paper object processing device after the paper object header is received by the one paper object processing device wherein the paper object coming precedes the paper object;
- processing the paper object in the paper object processing device and forwarding the paper object coming and the paper object to the another of the plural paper object processing devices wherein the above two steps are repeated for other paper objects in the current job until the last paper object is successfully delivered to the last paper object processing device in the route; and
- generating a paper object delivered in the last paper object processing device in the route and sending the paper object delivered to the output accessory manager.

The method is advantageous, since it can be applied regardless of the number of components in a paper processing system. A paper processing system comprises a main copier and/or printer unit to which numerous accessory devices are attached. An output accessory manager generates a paper object header for each paper object. The paper object header is routed through various and preferably all the paper object processing devices of the paper processing system. The paper object header comprises information about the identification of a paper object, the route, paper size and processes which had to be carried out on a paper object. Each paper object processing device adjusts itself due to the information from the paper object header. Additionally, each paper object processing device changes the content of information of the paper object header in that the information for adjusting the paper object processing device is extracted from the paper object header. The paper object header is absorbed in the last paper object processing device in the route and in the last paper object processing device a paper object header response is generated and sent to the output accessory manager. The information content of the paper object header response enables the output accessory manager to calculate the time delay between two paper objects.

A paper object coming in the form of a signal is generated in the output accessory manager, said signal arriving right before the arrival of the paper object at the first paper object processing device. The signal is routed to the downstream paper object processing devices.

Future advantageous embodiments of the invention are apparent from the dependent claims.

The invention, and its objects and advantages, will become more apparent in the detailed description of the preferred embodiments presented below.

BRIEF DESCRIPTION OF THE DRAWINGS

FIG. 2*a* shows a model of a multifunctional finisher, FIG. 2*b* shows a model of a paper supply module and FIG. 2*c* shows a model of a marking engine with a duplex path;

FIG. 8*a* represents the situation of a jam inside a paper object processing device, FIG. 8*b* represents the situation of a jam at the exit of a paper object processing device and FIG. 8*c* represents a jam at the entrance of a downstream paper object processing device.

In the specification below, the following abbreviations are used for the sake of simplicity:

| | |
|---|---|
| Paper processing system | PPS |
| Marking engine | ME |
| Output accessories manager | OAM |
| Module manager | MM |
| Paper object(s) | PO(s) |
| Paper object processing device(s) | POPD(s) |
| Paper object header | POH |
| Paper object header response | POHR |
| Paper object coming | POC |
| Paper object delivered | POD |
| Configuration request | ConfReq |
| Configuration response | ConfResp |
| Downstream accessory status | DAStat |
| Enable downstream accessory | EDAcc |
| Exception set | ExS |
| Exception dialog | ExD |
| Shutdown | SD |
| Exception cleared | ExC |
| Status | S |
| Status request | SReq |

In case one of the above expressions is used in the specification for the first time the expression is followed by the abbreviation in parentheses. From then on the abbreviation is used solely throughout the specification.

DETAILED DESCRIPTION OF THE INVENTION

A paper object (PO) is, for example, a sheet of paper with a print on one side (simplex) or a print on both sides (duplex). Additionally, a PO (one single sheet) comprising more than one page can be cut at a cutting unit in order to obtain single sheets (containing only one page). These single sheets have to be regarded as new POs. Moreover several sheets, each of them with one or more pages, can be collected in a collator. The so-called booklet is regarded as a single and new PO.

An identification belongs to each PO regardless of the specification of a PO. This means that the newly generated POs (for example by a cutter) receive an identification, too and the same applies to a PO which is generated by collating other POs (for example by a stapler). The identification is generated by an output accessory manager (OAM) and used to track and monitor a particular job. The OAM may be controlled by a computer such as a microcomputer suitably programmed to function in accordance with the description provided below.

A PO can be a sheet of paper, a transparency, a photo or any other medium which is accepted and handled by the paper processing system (PPS).

Figure 1:
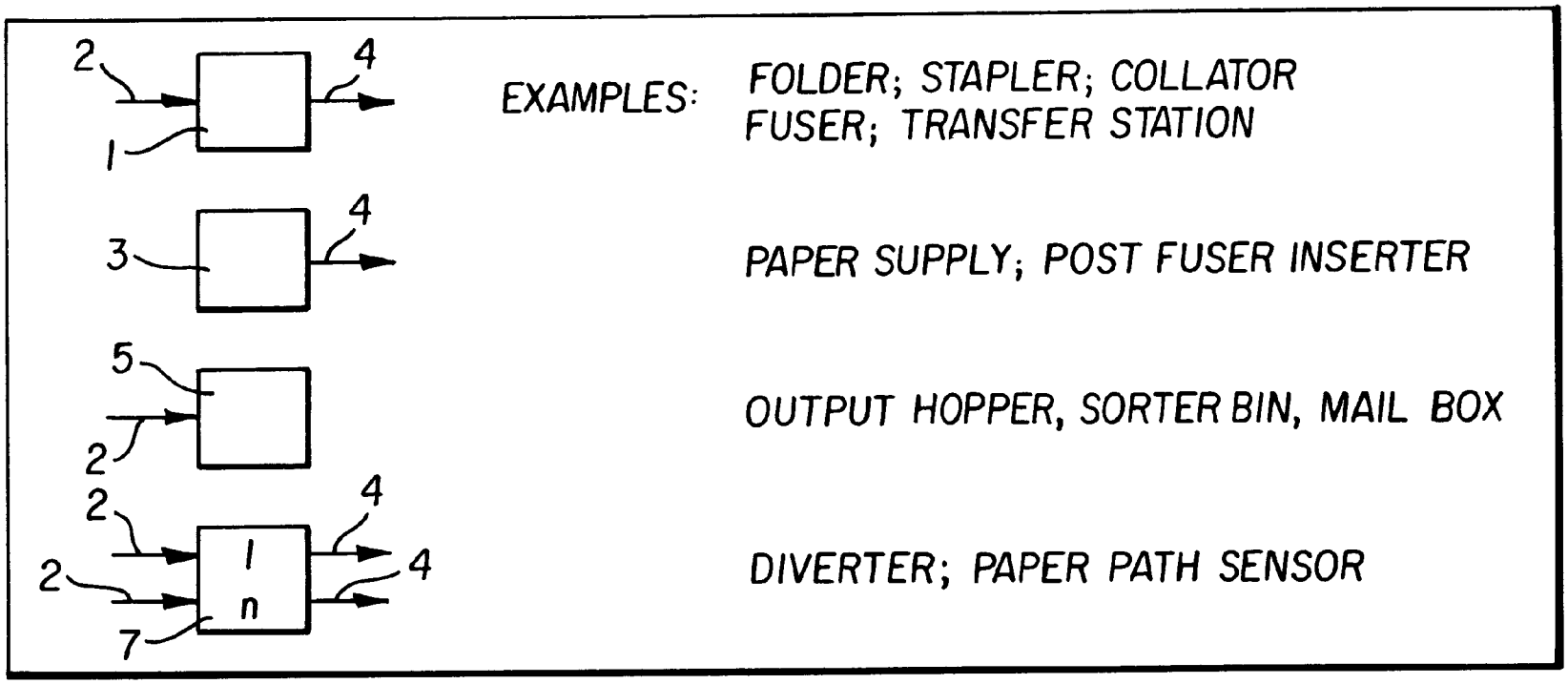
FIG. 1 is a schematic representation of the possible components of a paper processing system.

FIG. 1 shows the various components of the PPS. These components can be combined arbitrarily to form a PPS and any number of components may share one or more microcomputers (not shown) which are suitably programmed to function in accordance with the description provided below and which communicate with the OAM. A pass-through device 1 possesses an entrance 2 and an exit 4. Pass-through units are for example a folder, a stapler, a collator, a fuser or a transfer station. An input device 3 comprises an exit 4 and no entrance 2. Input devices 3 are for example a paper supply or a post fuser inserter. An output device 5 possesses one entrance 2 and no exit 4. Output devices 5 are for example an output hopper, a sorter bin or a mail box. A router device (pass-through device with several routes) 7 possesses 1 to n entrances 2 and 1 to n exits 4. Router devices 7 are for example a diverter or paper path sensors. Moreover, the paper path (path of the POs) in the PPS is monitored and controlled by a plurality of sensors (not shown). Consequently each paper object processing device (POPD) provides information for its own microcomputer controller and the OAM, which is used in accordance with a program routine for that POPD for monitoring and controlling the flow of the POs.

Figure 2A:
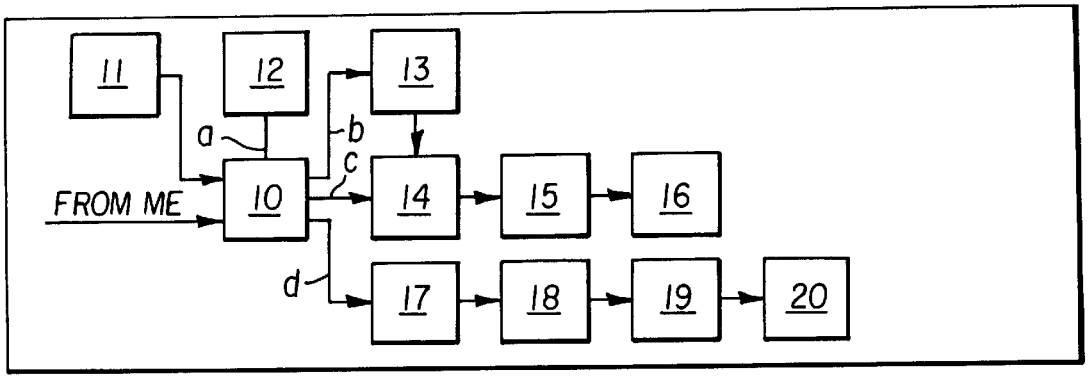
FIGS. 2*a* to 2*c* are various examples for combining the components of FIG. 1.

The combination of the components of a PPS brings out various models which are used to process POs. FIG. 2*a* discloses a model of a multifunctional finisher. From the marking engine (ME) POs are delivered to a router 10 which has an additional entrance connected with an inserter 11 in order to send additional POs to the router 10. The router 10 has four exits a, b, c and d. The first exit a leads to a trash tray 12 which is used as an output device to collect for example faulty POs to be taken out by the operator. The second exit b of the router 10 leads to a folder 13 whose exit ends in a collator 14. The third exit c of the router 10 leads directly to the collator 14. From here the POs are guided to a stitcher 15 and finally the paper path ends in an output hopper 16. The forth exit d of the router 10 leads directly to a second collator 17. From the collator 17 the paper path guides the POs to a stitcher 18, then to a folder 19 and finally they end in a hopper 20.

Figure 2B:
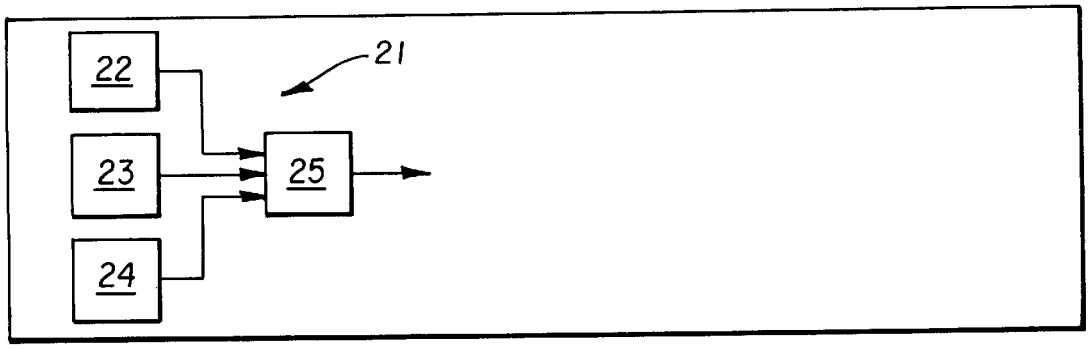

FIG. 2*b* shows a paper supply module 21 comprising three drawers 22, 23 and 24 whose exits lead to a router 25. The router 25 itself guides the POs to the downstream components.

Figure 2C:
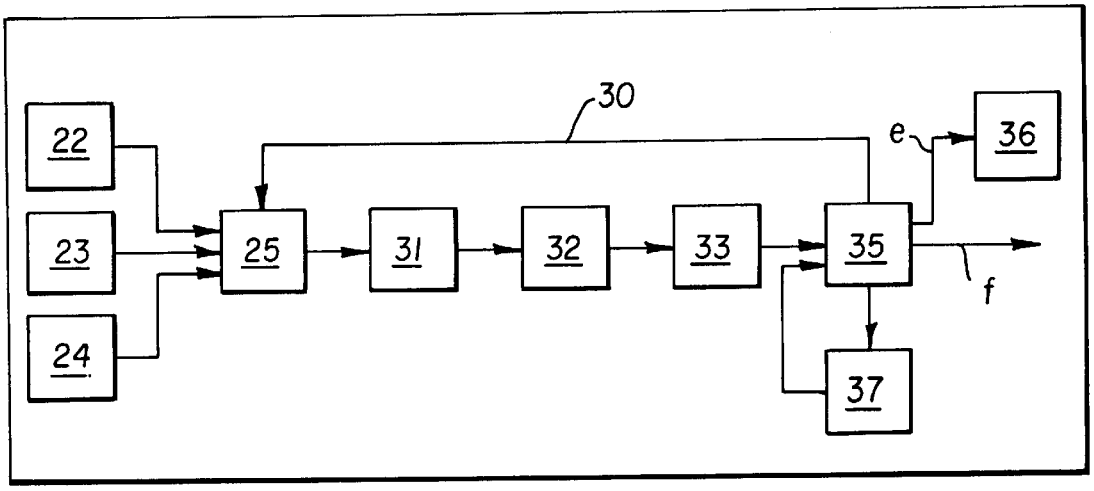

A third example discloses a model of a marking subsystem with duplex path 30 (FIG. 2*c*). The supply of the system with POs is carried out according to the scheme as disclosed in FIG. 2*b*. After the router 25 the POs pass a registration unit 31, a transfer unit 32 and a fuser 33. The path of the POs ends finally at a second router 35. Then the POs are routed via a first exit e to an exit tray 36, are guided via a second exit f to a further processing unit (not shown) or sent via a third exit g to an inverter 37. From the inverter 37 the POs are guided to the second router 35 and from there back to the first router 25 in order to carry out the copy and/or print process on the second side of the sheet of paper.

A POPD is the smallest entity of an accessory known to the output accessories manager process. It may have several inputs and outputs, and performs one or more specific functions on POs. A POPD which provides an output facility to the customer is called a final destination device.

For example the KODAK 1570 finisher (basic finisher plus saddle stitcher) is composed of an inserter, two folders, two collators, two staple units and two output hoppers (final destination). Grouping of POPDs is possible, too, and might be necessary due to mechanical constraints of the system. The KODAK 1570 finisher could also consist of one inserter, two folders, two staplers (containing a collating function) and two output hoppers.

Figure 3:
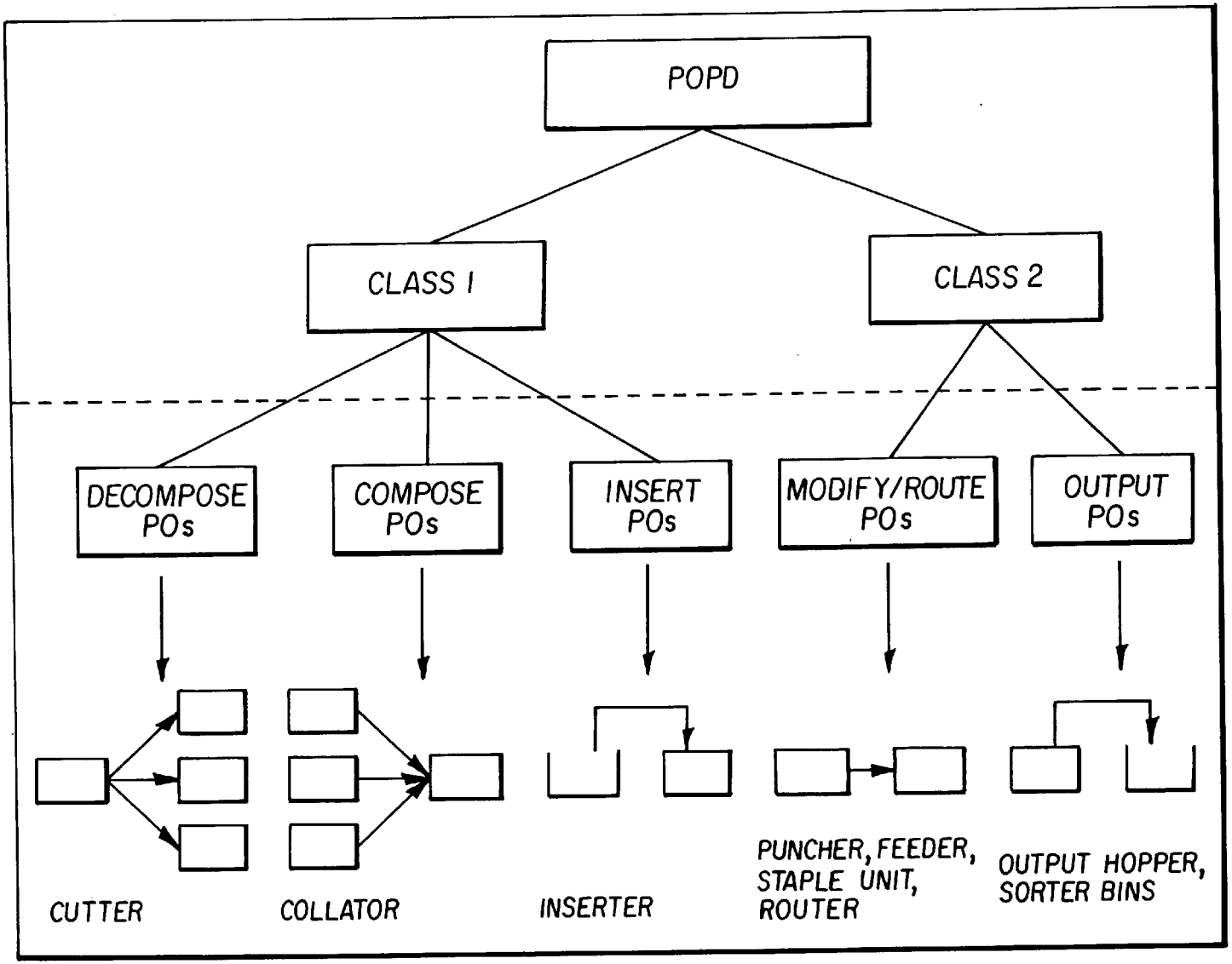
FIG. 3 is a schematic representation of various types of paper object processing devices.

FIG. 3 discloses some examples of POPDs which are divided into two classes. Class 1 comprises the POPDs where the number of outgoing POs differs from the number of incoming POs. Class 2 comprises POPDs where the number of outgoing POs is equal to the number of incoming POs.

A class 1 POPD has the object to independently control its output paper object stream (messages, message timing, moment when POs are output). This task should not be performed by the OAM (distributed control). Thus, modularity will be enhanced, interfaces defined more clearly and a division of operation between several design groups made easier. A class 2 POPD simply takes over the physical PO and its related messages from the predecessor, adjusts the timing according to its own process speed, and forwards it to the next downstream device.

Class 1 POPDs are called paper object flow control devices. They can decompose a PO and generate a new PO (cutter), compose POs and generate a new PO (collator) or insert a PO into the stream of POs (inserter).

Class 2 POPDs are called non-paper object flow control devices. They can modify a PO (folder, stapler), output POs to the customer (final destination devices, output hopper), control the PO output stream to the downstream devices or route or transport a PO (paper path, diverter).

The OAM which is located in the ME has to be informed about the exact configuration of finishing accessories and/or changes of the entire system. The installation provides the OAM with the necessary information to be able to control the system. Each POPD has an identification which characterizes its type, e.g. paper supply, collator, receiver bin, etc. In order to be able to uniquely identify a POPD, each one has an individual address. In combination with a node address on the network and a module address, it provides the necessary information for the routing of messages and POs.

Figure 4:
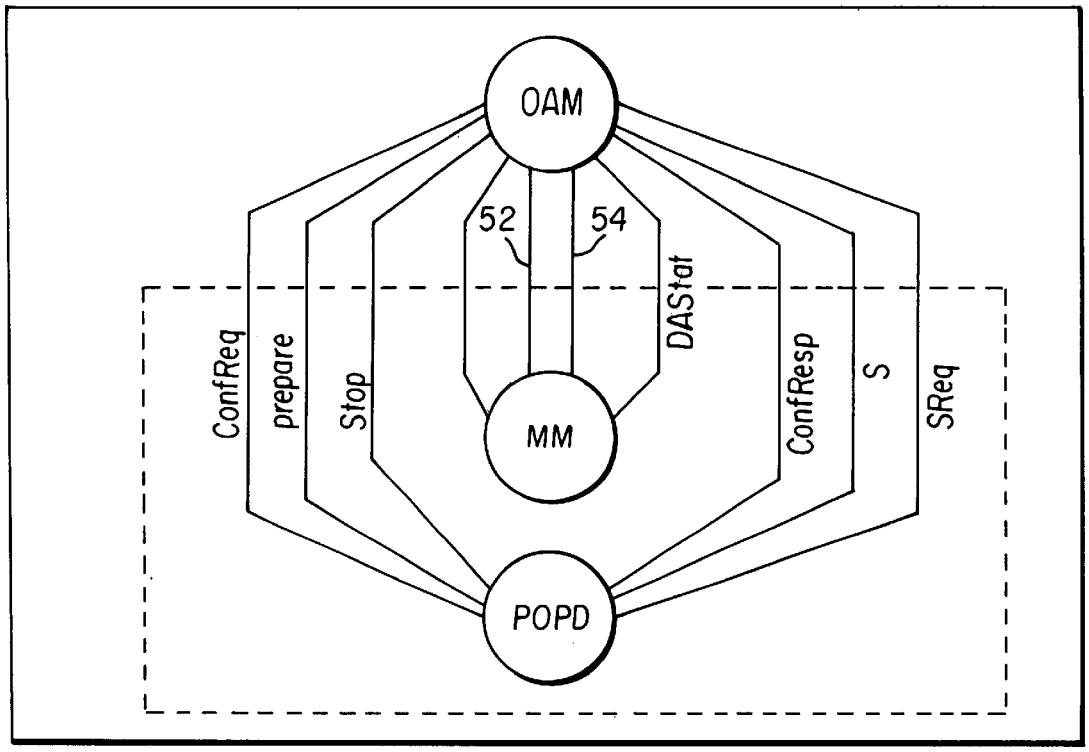
FIG. 4 is an overview of the initialization messages.

FIG. 4 discloses the control messages which are sent by the OAM. Immediately after the power of the ME is turned on the OAM sends a wake-up message 52 to the module manager (MM). Each MM in the system sends a wake-up response 54 back to the OAM. The wake-up response 54 to the OAM comprises information about the POPDs and the paper paths which belong to a particular MM. This information is sent every time the system is powered on. The information consists of the address of the MM, types of used POPDs, addresses of the POPDs, paper path information and type of the modules/accessories.

The OAM sends to each POPD a configuration request (ConfReq) as soon as OAM receives the wake-up response 54 from all MMs. In response to the ConfReq each POPD in the system sends a configuration response (ConfResp) to the OAM in order to inform it about its special capabilities. Only static data which does not change during one power-up cycle is contained in this message. All dynamic data is transmitted in a status message (S) (see below).

Directly after the wake-up response 54 or whenever the power status of a downstream accessory changes, the MM additionally sends a downstream accessory status (DAStat) to the OAM. This message informs the OAM about the power status of a downstream accessory. If powered off, the configuration is complete (power off during initialization), or every accessory downstream of the one sending this message must be removed from the OAM configuration (power off reported after initialization). If powered on, another accessory must be enabled to join the network and to be added to the OAM configuration. After receiving the DAStat from the MM the OAM sends an enable downstream accessory (EDAcc). This message is sent to a MM which is reported that a downstream accessory is powered on.

Any time the OAM wants to know the status of a POPD the OAM sends a status request (StatusReq). Usually, each change of the status is sent to the OAM automatically. There are certain error cases (exceptions), however, for which the StatusReq message is useful.

Each POPD sends a status message (S) directly to the OAM whenever any of the status records in this message changes state. In the S message the POPDs transmit their dynamic data to the OAM whenever one of the records in this message changes state. Therefore the status message is not only part of the initialization procedure, but also of job control and exception handling.

Additionally, the OAM sends a prepare message to a particular POPD. This message is used to prepare an accessory with long initialization time (e.g. binder) for operation. Preparing an accessory, like a binder, to run might take a long time. In those cases the operator should select the required feature on an operator control interface (not shown) and be informed when the job can be started. Moreover, a POPD which needs a prepare message to reach a state in which it can operate must inform the OAM about that fact in its ConfResp message.

The OAM sends a stop message to a particular POPD to turn off accessories which need to prepare messages for initialization (e.g. a binder to turn off the heating unit).

Figure 5:
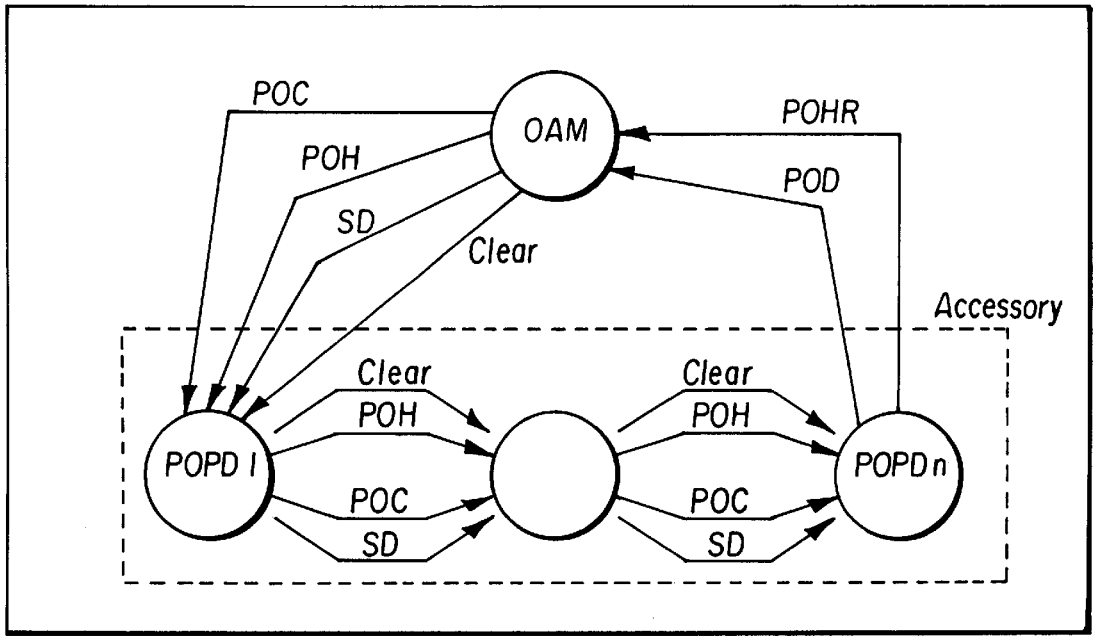
FIG. 5 is an overview of the job control messages.

FIG. 5 describes the messages used for controlling the flow of POs through the system. The OAM generates a paper object header (POH) and the POH is cascaded from POPD to POPD. The POH is generated when the OAM has job and page information for a particular PO (before images are written). The POH provides information about a specific PO, for example a PO identifier, PO route, paper size and/or features to be performed on a PO. It is important that the POH be available to a POPD before the PO arrives at the POPD. Additionally, one part of the POH message comprises a paper object header response (POHR).

The POPDs receiving a POH store it and use it to set themselves up properly (e.g. adjust to paper size) and to route the PO to the next device. As the POH together with the POHR is cascaded down the route, each POPD modifies the message by stripping off the feature information relevant only to itself, and changing the paper size, if needed (folder). Each POPD calculates (see below) the time required for preparation and for flow through. The flow through time of the POH received by the first POPD in the route is preset in response to the time at which the leading edge of the corresponding PO will arrive at its entrance (time for first leading edge after start up is 0, then it increases depending on the frame size of the marking engine and the amount of ordered delay time).

If a (preparation) delay is requested in the POHR, then the corresponding POH must be recirculated through the route again, this time with updated flow_time information, considering the number of skip frames necessary to introduce the requested delay. Thus, each POPD can update its time table for the corresponding PO. The response to this updated POH should not contain a skip time request anymore. POPDs receiving a POH with the same PO identification twice, overwrite the previous entry in their tables and update their processing and flow through time calculation.

For each PO a POH must be available. The POH must be available to the POPD before the image of the corresponding PO is printed. In the final destination POPD the POH is absorbed. A new POH can only be generated if the previous POHR has returned to the OAM.

A POPD may hold on to the POH if its POH buffer has been filled. Each POH should be cleared from the buffer by the POPD after the PO has been completely processed (i.e. the POPD has sent a paper object coming message (POC) to the next POPD in the route and the PO is no longer in the domain of the POPD). A POH always contains the route from the first finishing accessory POPD to the final destination POPD.

For future optimization, an information field can be introduced which indicates that the current POH is exactly equal to the previous POH, except for the PO identification. In this case, all route and feature information is supplemented by the receiving POPD. The POHR is generated after the POH was received by the final destination POPD. The final destination POPD receives a POH, it extracts the information referring to the requested preparation time, and generates the POHR. For each sheet one POHR must be returned to the OAM. The POH for the following PO cannot be sent until the POHR for the previous PO was received by the OAM. If a delay was requested in the POHR, the same POH with updated flow_time information for the POPDs is recirculated, and should not generate a request for delay time again.

Each POPD has to know two different time values, requiring two different data fields in the POH to store them. The first time value is the preparation time (t_prep), which is the time needed for preparation before a PO is accepted by a POPD. The second time is the flow through time (t_flow), which is the time the leading edge of a PO needs to pass through a POPD. The preparation time is returned to the OAM in the POHR. The calculation of the preparation time (t_prep) and the flow through time (t_flow) is shown below. The suffix n represents the value for the current POPD, the suffix n−1 represents the value for the upstream POPD (default is zero) and the suffix n+1 represents the value for the downstream POPD.

The preparation time is as follows:

T_PREP=const.

t_prep_n=T_PREP−(t_flow$_{n-1}$ (current POH)−t_flow_n−1 (previous POH))

IF (t_prep_n−1>=t_prep_n)

THEN (t_prep_n+1=t_prep_n−1)

ELSE (t_prep_n+1=t_prep_n)

The flow through time is as follows:

t_flow_n+1=t_flow_n−1+t_flow_n

A paper object coming (POC) is generated in the OAM and cascaded from POPD to POPD until it reaches the final destination POPD. The POC is sent a few milliseconds ahead of a PO, wherein the time ahead of the PO depends on the mechanics of the POPDs and the speed of the POs. The POC is the real time information associated with a PO and proceeds that PO by a few milliseconds. It is used as a pointer to the data structure which was built in each accessory POPD with the information in the POH. The first accessory POPD in the route receives this message from the ME.

The virtual field in the message is set to "1", if the POC is not followed by a physical PO, which is the case with a post fuser inserter. POPDs receiving this message have to forward it in the correct timing, without processing a PO (i.e. they function in a "paper feed inhibit mode"). The post fuser inserter uses this message as a feed trigger, resets the field to "0" and introduces the PO into the job stream. The virtual field is mainly used for debugging purposes, otherwise it is redundant because the information is already sent in the POH. During exception handling, POPDs which are on the redirection route and do not belong to the original route of the job, must be given the route information in real time because there is no time left to send POHs anymore. In general, a POPD must be able to accept and process POs without having received a POH before. In the present case, it is assumed that it received the route and feature information in the POC and that it does not need any delay time for the processing, or the delay time was already provided by the ME.

The message paper object delivered (POD) is generated in the final POPD and sent directly to the OAM. The POD is generated when the PO (single sheet, booklet, etc.) arrives at its final destination. The OAM uses this information for billing and job tracking purposes and to free memory space.

A shutdown message (SD) is sent when the OAM wants the accessories to perform a controlled cycle down at the end of a job (-queue). The SD is sent immediately following the last POC. For a detailed description of this message, please refer to exception handling.

A clear message is generated in the OAM and cascades from POPD to POPD to the last POPD in the route. The clear message is sent when the operator requests to discard a current job. This message can only be sent when the system is in a stand-by state, i.e. not processing any paper and waiting for customer input. The message is cascaded along the route of the last active job before the system went into stand-by. Upon reception, the POPDs clear their paper path. All paper is cycled out to the final destination device.

The job control sequence is as follows:

The OAM sends a POH to the first POPD in the output accessory.

The POPD updates and forwards the POH to next downstream POPD.

This sequence continues until the last POPD in route absorbs the POH and generates and returns POHR to the OAM.

If the POHR contains a request for delay time, the same POH with updated flow_time information is recirculated again.

The sequence is repeated for all POs in a job.

After the first POH is received, the first POPD in output accessory receives the POC from the OAM, preceding the PO by a few milliseconds.

The POPD processes the PO and forwards the POC and PO to the next downstream POPD.

The sequence continues until the last PO is successfully delivered to the final destination POPD.

The final destination POPD sends the POD to the OAM.

If no other job has to be processed, the OAM sends a shutdown message along the route of the last job.

Figure 6:
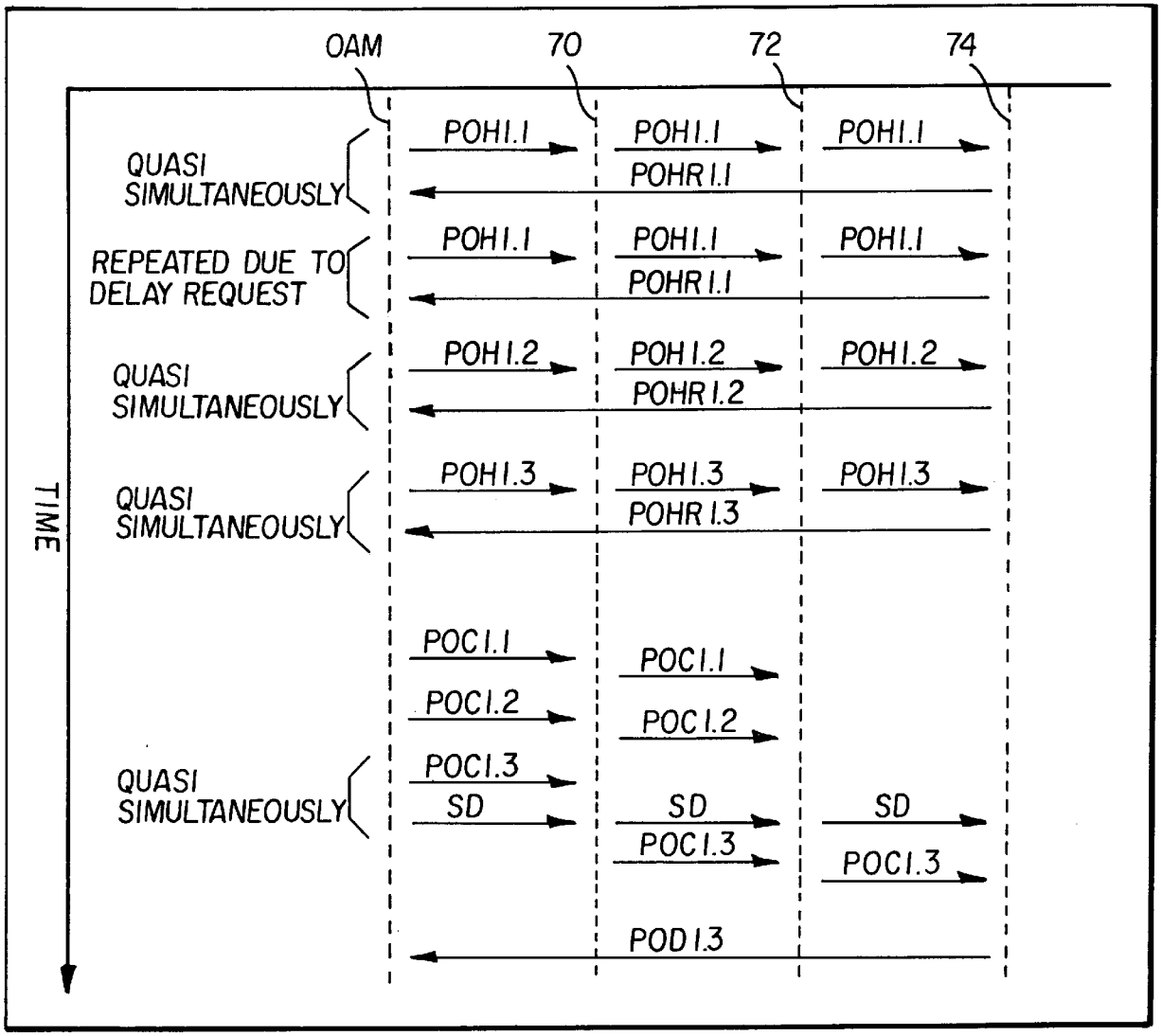
FIG. 6 is a message flow diagram for a booklet, consisting of three sheets.

The message flow in a PPS is explained for a 3-sheet booklet (see FIG. 6). The PPS comprises the ME with the OAM implemented in it and three POPDs, a bypass 70, a collator/stapler 72 and a stacker 74. Furthermore, FIG. 6 gives an insight into the timing of the various messages sent by the OAM.

The OAM sends a POH1.1 for the first PO to the bypass 70. The bypass 70 updates and forwards the POH1.1 to the collator/stapler 72. The collator/stapler 72 updates and forwards the POH1.1 to the stacker 74, asking for 300 milliseconds preparation time (other preparation times are possible). The stacker 74 generates and forwards a POHR1.1 (requesting 300 milliseconds pre-delay) to the OAM; The OAM sends the POH1.1 again, containing updated flow_time information (see Table 1 below). The POH1.2 and POH1.3 do not generate requests for delay time. The POH1.3 carries the "last PO of booklet" information. Shortly before the bypass 70 receives the PO1.1, it receives the POC1.1 from the OAM. The bypass 70 receives the PO1.1, processes it as requested in the POH1.1 and forwards the POC1.1 to the collator/stapler 72. The POC1.1 precedes the PO1.1 by a few milliseconds. The collator/stapler 72 receives the POC1.1 and the PO1.1 and processes the PO1.1 as requested in the POH1.1. The same timing and process is valid for POC/PO1.2 and POC/PO1.3. As soon as OAM sends the POC 1.3, the OAM sends the SD along the route to prepare the PPS to shut down after having processed the PO1.3. After the collator/stapler 72 receives the PO1.3, the collator/stapler forwards the POC1.3 and the PO1.3 to the stacker 74. The stacker 74 processes the PO1.3 and then sends the POD 1.3 to the OAM. As each POPD finishes the processing of PO1.3, it shuts down.

Table 1 shows the timing values which are forwarded in the POH to the next downstream device. Each POPD calculates and updates the preparation time (prep_time) and flow_time (flow_time) information. The POHR is returned to the OAM. Because, as mentioned above, the first response requests additional delay, POH1.1 is sent through the route again, containing new flow_time information (it is assumed that one frame is equal to 500 milliseconds). This gives each POPD the opportunity to update its time table. The flow through times for the POPDs are assumed to be 800 milliseconds for the bypass 70, 400 milliseconds for the collator/stapler 72 and 500 milliseconds for the stacker 74 (only relevant for delivery of a booklet). The collator/stapler 74 needs 1100 milliseconds preparation time before it is able to process the first PO.

TABLE 1

| PO ID | time [ms] | OAM | bypass | collator/ stapler | stacker | POHR |
|---|---|---|---|---|---|---|
| 1.1 | prep_time | 0 | 0 | 300 | 300 | 300 |
| | flow_time | 0 | | 1200 | 1200 | / |
| 1.1 | prep_time | 0 | 0 | 0 | 0 | 0 |
| | flow_time | 500 | 1300 | 1700 | 1700 | / |
| 1.2 | prep_time | 0 | 0 | 0 | 0 | 0 |
| | flow_time | 1000 | 1800 | 2200 | 2200 | / |
| 1.3 | prep_time | 0 | 0 | 0 | 0 | 0 |
| | flow_time | 1500 | 2300 | 2700 | 3200 | / |

It is possible to set the flow_time of the first PO after start-up to a value other than zero. If the flow through time of the ME paper path were contained in this field, first copy out time could be optimized. For example, if the POH1.1 were sent to the bypass 70 with a 1000 milliseconds in the flow_time field (indicating that it takes one second before this PO reaches the exit of the ME), the collator/stapler 72 POPD would not have to order an additional prep_time of 300 milliseconds.

Exception Handling

Herein the different types of exceptions, their handling, and the principle of recovery are disclosed. In general, the OAM queues and prioritizes the exception messages. The exception handling does only not deal with paper jams, but also with hardware and software failure, and events in the system which should be flagged to the operator.

Figure 7:
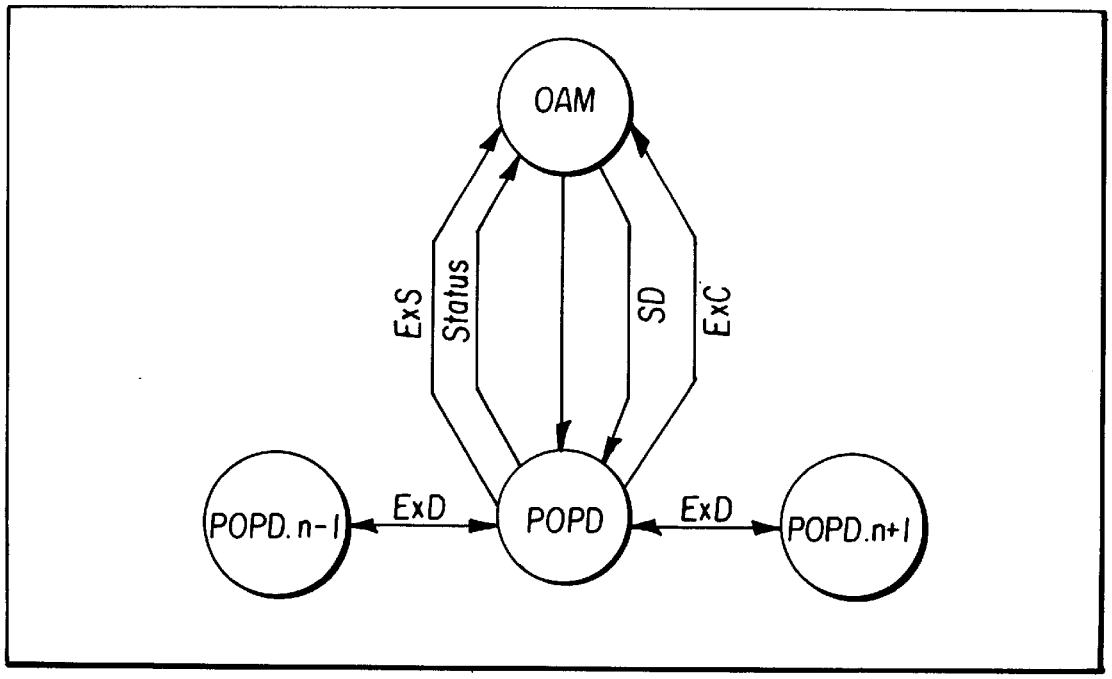
FIG. 7 is an overview of the exception messages.

FIG. 7 discloses the messages sent from and to the OAM during an exception. A POPD immediately sends an exception set (ExS) to the OAM when the POPD discovers an exception. With this message, the POPD reports an exception to OAM.

If an exception is detected in a POPD, it usually has a ripple effect on neighboring POPDs. This is the case if several POPDs share some input/output and the POPD with the exception has to shut down. If, for example, a transport module motor has to be turned off because of a paper jam, several other POPDs (i.e. POPD_n−1, POPD_n, POPD_n+1) might be unable to continue processing. These POPDs generate status messages, indicating their problem and the identification of the last PO which they processed successfully. Thus, the OAM gets a list of all affected POPDs, as well as the identification of the last PO which was successfully processed by this group of POPDs. This is the identification needed for recovery. Additionally, a POPD generating an exception set (ExS) for a hard or soft shutdown always generates a status message (S) as well, because its status changed.

This POPD which detects an exception sends an exception dialog (ExD) to an upstream or downstream POPD. The ExD is sent to the upstream POPD if the exception is an "entrance" jam and the ExD is sent to the downstream POPD if the exception is an "exit" jam.

Figure 8A:
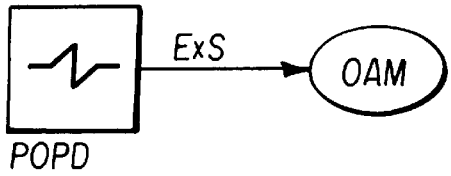
FIGS. 8*a* to 8*c* are various examples for the message flow according to the occurrence of an exception.
Figure 8B:
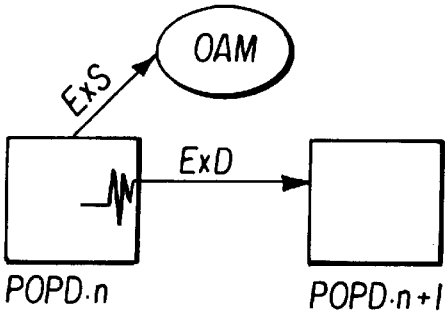
Figure 8C:
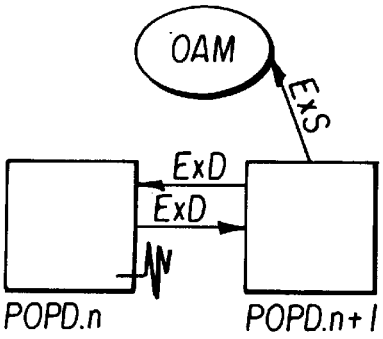

The ExD message is only used in the accessory and between different accessories; the ME and the OAM never receive or send this message. FIGS. 8*a* to 8*c* show the three possibilities of where a PO jam can occur in a POPD, requiring different procedures. In general, the POPD which detects the exception first sends the ExS to the OAM:

FIG. 8*a* shows the occurrence of a jam "inside" the POPD. The trailing end of the PO has already been detected at the POPD entrance. The POC for this PO has not yet been forwarded to next downstream POPD. Therefore, the POPD sends the ExS directly to the OAM and no ExD is needed.

FIG. 8*b* shows the occurrence of a jam "at exit" of the POPD and the trailing edge of the PO is missing. The POC has already been forwarded to the downstream POPD which is now waiting for the delivery of a PO. The PO is still under control of the POPD for detection of its trailing edge. In this case, both POPDs are tracking the progression of the same PO. The actual POPD sends the ExS to the OAM and the ExD to the downstream POPD, which disables jam detection for that PO. The ExD is not returned from the downstream POPD to the upstream POPD.

The third example for an exception is declassed in FIG. 8*c*. The jam occurs "at entrance" of the downstream POPD and the leading edge of the PO is missing. The downstream POPD has already received the POC from the upstream POPD and is waiting for leading edge of the PO. Both POPDs are tracking progression of the same PO. The downstream POPD sends the ExD to the upstream POPD. The upstream POPD disables the jam detection for that PO and returns the ExD to the downstream POPD as an indication that it will not generate an exception itself. The downstream POPD sends the ExS to the OAM. This eliminates the risk of follow-on exceptions being reported. The upstream POPD stops the delivery of POs to the jammed POPD, thus minimizing potential damage to the system. The jammed POPD knows the addresses of its immediate neighbors from the route information in its POH-table.

Other messages which are not shown in FIGS. 8*a* to 8*c* are a shutdown (SD), a divert (D) and an exception cleared (ExC).

The SD is sent as soon as the OAM knows that the identification of the last PO is exiting the ME at the end of a job (controlled shutdown or exception with redirection). In an exception case, the OAM sends an SD as soon as the OAM knows the identification of the last successfully processed PO.

The SD is used in several cases:

When the OAM wants to cycle down the accessories at the end of a job, SD is sent as soon as the last POC was sent. It is cascaded down the route which must cycle down.

When handling a shutdown with redirection, all POPDs affected by the exception condition (e.g. paperjam) report their status to the OAM. When all those POPDs have responded, the OAM knows which PO was the last successfully processed one. It generates an SD for that route of the PPS, which is not part of the redirection route, containing this PO's identification. POPDs which already processed this PO (upstream from jam) shut down immediately, POPDs which have not yet processed this PO (downstream from jam) continue to run until they finished processing it.

When the last POC is sent during an exception with redirection, the OAM includes its PO-identification in yet another SD, which this time is sent along the redirection route, causing all POPDs to cycle down after they finished processing the corresponding PO.

An SD with redirection also requires a time critical Divert message to the responsible router POPD (see below).

A divert (D) message is generated in the OAM and directed to a router POPD which is responsible for redirecting POs to the trash tray in case of a shutdown with redirection. The D is sent immediately in response to an ExS, if an alternative paper path to the trash tray is available (see FIG. 7). This message is only used for the handling of exceptions with redirections. When the OAM receives an ExS for a hard shutdown, it checks whether a redirection route to the trash tray is available. If so, a D message is sent immediately to the router POPD responsible for switching to the trash tray route. This is very critical, because paper can be in the path and the diverter must be turned as soon as possible.

An exception cleared message (ExC) is generated in the POPD which reported the exception and is sent directly to the OAM when exception is cleared. This message reports to the OAM that an exception has been cleared. When all POPDs affected by the exception are READY the job can be restarted.

When a POPD sends an ExS message to the OAM, it includes one of three different types of exceptions, based on what kind of shutdown is necessary. The types are a warning, a hard shutdown or a soft shutdown.

A POPD sends a warning to the OAM if a condition occurs which does not require a shutdown, but has to be brought to the operator's attention, e.g. hopper almost full, one staple missing, etc. The warning is sent to the OAM in the ExS message. No S message is returned. If the exception is cleared in the POPD (e.g. next staple is good, or the operator emptied the almost full hopper), it sends an ExC message to the OAM. If the warning leads to another exception, requiring a shutdown (two staples missing or hopper full), the POPD first sends this new exception message, then it sends the ExC for the warning. In this case no recovery is necessary.

A hard shutdown immediately stops all mechanical operations in the affected POPD, in order to avoid damage to parts or a severe disruption of the job stream. Two different scenarios are possible:

a) all POPDs in the current route have to shut down hard;

b) only the POPD which has reported the exception (and neighboring POPDs, if affected because of shared i/o, etc.) has to shut down hard; the others shut down softly and the PO route will be changed to avoid the stopped POPD.

The POPD sends an ExS message to the OAM and shuts down immediately. The OAM checks whether an alternative paper path (e.g. to a trash tray) is available. If so, it sends a D message to the responsible router POPD immediately, followed by one SD to that part of the original route which is not part of the redirection route, as soon as it determined the identification of the last successfully processed PO. Now, POPDs upstream of the problem area can cycle down immediately, while those downstream continue to run until they processed the specified PO. Finally, when the last POC is sent, the OAM generates another SD with the identification of the last PO to leave the ME, and sends it along the redirection route. All affected POPDs may now cycle down after they finished processing of the last PO. If no alternative route is available, the OAM waits to receive S messages from POPDs affected by the exception. Then it sends a SD with the identification of the last successfully processed PO along the original route, causing all POPDs upstream the problem area to cycle down immediately, while those downstream continue to run until they processed the specified PO. The POH tables which are stored in each POPD are erased. They will be recreated after restart. If a redirection route is specified, the router POPD which switches between original and redirection routes announces the POs which it sends to the redirection route in a POC.

During the recovery procedure of a hard shutdown, the operator will be informed to remove the cause of the exception. Then, the POPD which reported the exception sends an ExC message to the OAM, followed by an S message. If all other POPDs in the subsystem are READY, the job can be restarted by first sending the header of the PO which jammed.

A soft shutdown is necessary, when a POPD reaches an operation boundary (e.g. hopper full) or runs out of a consumable material (e. g. staples). A soft shutdown is also performed for a "stop job" request from the user.

The POPD sends an ExS message to the OAM. When it generates the last POC, the OAM sends an S message to all POPDs in the route, including information after which PO to shut down. Any remaining contents in the POH tables are erased. Or, in case of a "stop job" request, the OAM sends the S message without having received an ExS message.

During the recovery procedure of a soft shutdown, the operator is informed to remove the cause of the exception (e.g. empty hopper; replace staple cartridge, . . . ). Then, the POPD which reported the exception sends an ExC message to the OAM, followed by a status message. If all POPDs in the subsystem are READY, the job can be restarted with the next POH.

Figure 9:
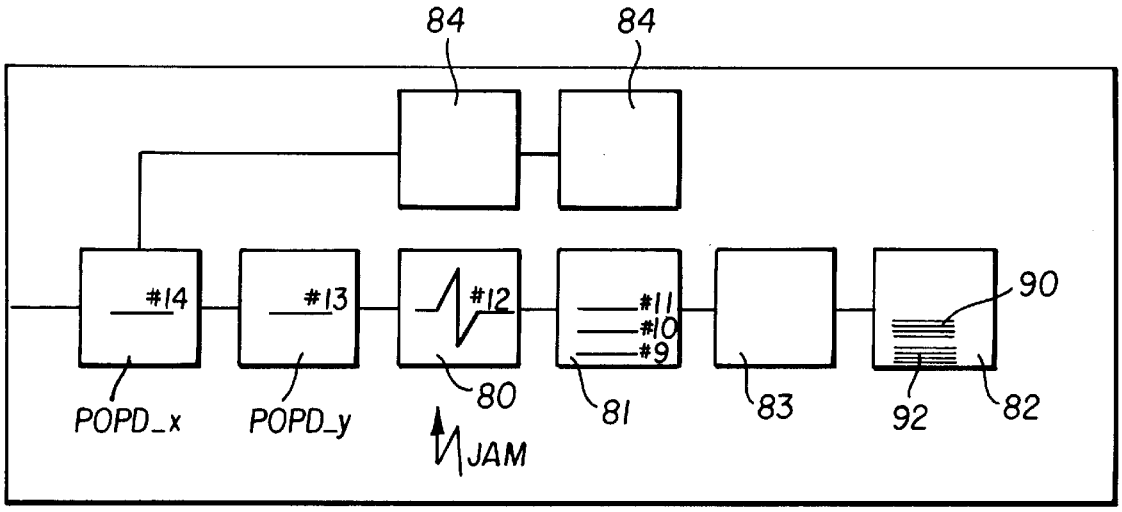
FIG. 9 represents the situation of a hard shutdown of the paper processing system.

FIG. 9 shows an example for a hard shutdown. The job to be handled by the PPS comprises four sheets per set, which are to be stapled and folded, and sent to the final destination (hopper 82). The status is that PO #12 jams inside a folder 80, while the POs #9 . . . #11 are in a collator 81 and two booklets 90 and 92 were delivered to the hopper 82 already. The PO #20 was just fed from the paper supply (not shown).

The folder 80 sends an ExS message to the OAM, indicating that it has a hard shutdown condition and that the jammed PO is #12. The folder 80 sends a status message to the OAM, including the identification of the last successfully processed PO (#11), indicating that it is NOT READY. The folder 80 performs a hard shutdown by stopping all mechanical processing immediately. The OAM realizes the possibility of redirecting the PO-stream to a trash tray 84, and sends a divert message to POPD x (router), which switches its diverter to the corresponding route. When the OAM has received all status messages, it sends an SD, including the identification of the last successfully processed PO, along the route between POPD_y and the hopper 82. Since the POPD_y has already processed PO #11, it performs a hard shutdown. The collator 81, stapler 83 and hopper 82 know that PO #11 is not the last PO of the booklet. Therefore, the collator 81 finishes the processing of PO #11 and shuts down, the stapler 83 and hopper 82 do not wait for a delivery because they only deal with complete booklets, and shut down as well. POPD_y sends a status message to the OAM, indicating that it is NOT READY (PO #13 blocks its path). The remaining POs in process (#14 . . . #20) are redirected to the trash tray 84 by POPD x, which generates POCs with route information for the trash tray route. This prepares the POPDs on the new route for the coming POs. As soon as the OAM sent the last POC, it includes its PO-identification in another SD, which it sends along the redirection route to the trash tray 84. As each POPD on the redirection route finishes the processing of PO #20, it shuts down and erases its POH table. The operator performs jam clearance on POPD_y and the folder 80. The folder 80 sends an ExC message to the OAM. POPD_y and the folder 82 send status messages to the OAM, indicating that they are READY. The OAM restarts the job by sending POH #12.

In case the hopper 82 is full, this is a condition for a soft shutdown. The hopper 82 sends an ExS message to the OAM. As soon as it has sent the last POC, the OAM sends a shutdown message to all POPDs in the route, indicating after which PO they have to shut down. The remaining POs in the paper path are finished as requested in the POH and cycled out to the hopper 82. Any remaining contents in the POH tables are erased. The operator empties the hopper 82. The hopper 82 sends an ExC message to the OAM. The OAM restarts the job by sending the next POH in the sequence.

There is a stop job condition in which the operator presses the "STOP"-button. As soon as it has sent the last POC, the OAM sends a shutdown message to all POPDs in the route, indicating after which PO they have to shut down. The remaining POs are finished as requested in the POH and cycled out to their final destination. Any remaining contents in the POH tables are erased. When the operator presses the "START"-button, the OAM restarts the job by sending the next POH in the sequence.

The invention has been described in detail with particular reference to certain preferred embodiments thereof, but it will be understood that variations and modifications can be effected within the spirit and scope of the invention.

What is claimed is:

1. A method for controlling the flow of paper objects in a paper processing system (PPS), having a main copier and/or printer unit with an output accessory manager (OAM) and plural paper object processing devices ($POPD_1$ $POPD_2$, . . . $POPD_n$) comprising the steps:

generating a paper object header (POH) for a paper object (PO) in the output accessory manager (OAM);

sending the paper object header (POH) to one of plural downstream paper object processing devices (POPDs) prior to the arrival of a paper object (PO) at the one paper object processing device (POPD), wherein the paper object header (POH) is updated and modified and sent to another of the plural paper object processing devices along a route;

absorbing the paper object header (POH) in a last paper object processing device (POPD) of the plural paper object processing devices in the route and generating in the last paper object processing device (POPD) a paper object header response (POHR) and sending the paper object header response (POHR) to the output accessory manager (OAM);

repeating the above steps for other paper objects (POs) in a current job;

generating a paper object coming (POC) in the output accessory manager (OAM) and sending the paper object coming (POC) to the one paper object processing device (POPD) after the paper object header (POH) is received by the one paper object processing device (POPD) wherein the paper object coming (POC) precedes the paper object;

processing the paper object (PO) in the paper object processing device (POPD) and forwarding the paper object coming (POC) and the paper object (PO) to the another of the plural paper object processing devices (POPD) wherein the above two steps are repeated for other paper objects in the current job until the last paper object (PO) is successfully delivered to the last paper object processing device (POPD) in the route; and generating a paper object delivered (POD) in the last paper object processing device (POPD) in the route and sending the paper object delivered (POD) to the output accessory manager (OAM).

2. Method according to claim 1, wherein said paper object header (POH) comprises information about the identification of a paper object (PO), the route, paper size and processes which had to be carried out on a paper object (PO).

3. Method according to claim 1, wherein said paper object processing device (POPD) changes the content of information of the paper object header (POH) in that the information for adjusting the paper object processing device (POPD) is extracted form the paper object header (POH).

4. Method according to claim 1, wherein the paper object header (POH) comprises two different time values, a preparation time (t_prep) and a flow through time (t_flow), the preparation time (t_prep) being the time needed to prepare a paper object processing device (POPD) before a paper object (PO) is accepted, and the flow through time (t_flow) being the time the leading edge of a paper object (PO) needs to pass a paper object processing device (POPD), and that the time values are stored in two different data fields.

5. Method according to claim 4, wherein only the preparation time (t_prep) is returned with the paper object header response (POHR) to the output accessory manager (OAM).

6. Method according to claim 1, wherein the paper object coming (POC) is sent to the paper object processing device (POPD), without a following paper object (PO), said device uses the paper object coming (POC) for self-adjustment.

7. Method according to claim 1, wherein the paper object header response (POHR) contains information which is used in the output accessory manager (OAM) for printing bills, tracking a job and clearing memory space.

8. Method according to claim 1, wherein a power up procedure of the paper processing system (PPS) comprises the following steps:

controlling of the paper object processing devices (POPDs) by a microprocessor which is associated with at least one paper object processing device (POPD);

loading the configuration from a look-up table of the module manager;

sending a configuration request (ConfReq) of the output accessory manager (OAM) to the available paper object processing devices (POPDs); and sending back a configuration response (ConfResp) of each paper object processing device (POPD) to the output accessory manager (OAM).

9. Method according to claim 1, wherein a shutdown of the paper processing system (PPS) is carried out on occurrence of an exception, the shutdown comprises the following steps:

sending a shutdown message to all paper object processing devices (POPDs) in the active route;

selecting on shutdown message the type of shutdown, wherein each paper object processing device (POPD) selects the type of shutdown;

diverting to an available paper path in order to empty the paper processing system (PPS) from paper objects (PO).

10. Method according to claim 9, wherein the paper object processing device (POPD) with the exception checks if the paper object processing device (POPD) is located in an alternative route and according to the result of the check the paper object processing device (POPD) decides if the processing of paper objects (PO) is continued or terminated at once.

11. Method according to claim 10, wherein the paper object processing device (POPD) terminates the processing or the accepting of paper objects (POs) at once, if the paper objects (Pos) are bound for the trash tray.

12. Method according to claim 1, wherein sensors are arranged in the paper path of the paper processing system (PPS), and that the sensors provide information for paper object processing devices (POPDs) and the output accessory manager (OAM), about the flow of paper objects (POs).

13. A method for controlling the flow of paper objects in a paper processing system (PPS), having a main copier and/or printer unit with an output accessory manager (OAM) and at least one paper object processing device ($POPD_1$ $POPD_2$, . . . $POPD_n$) comprising the steps:

generating a paper object header (POH) for each paper object (PO) in the output accessory manager (OAM);

sending the paper object header (POH) to downstream paper object processing devices (POPDs) prior to the arrival of a paper object (PO) at the specific paper object processing device (POPD), wherein the paper object header (POH) is updated and modified by each paper object processing device (POPD);

absorbing the paper object header (POH) in the last paper object processing device (POPD) in the route and generating in the last paper object processing device (POPD) a paper object header response (POHR) and sending the paper object header response (POHR) to the output accessory manager (OAM);

repeating the above steps for all paper objects (POs) in a current job;

generating a paper object coming (POC) in the output accessory manager (OAM) and sending the paper object coming (POC) to the first paper object processing device (POPD) after the first paper object header (POH) is received by the first paper object processing device (POPD) wherein the paper object coming (POC) precedes the paper object by a few milliseconds;

processing the paper object (PO) in the paper object processing device (POPD) and forwarding the paper object coming (POC) and the paper object (PO) to the next downstream paper object processing device (POPD) wherein the above two steps are repeated until the last paper object (PO) is successfully delivered to the last paper object processing device (POPD) in the route; and generating a paper object delivered (POD) in the last paper object processing device (POPD) in the route and sending the paper object delivered (POD) to the output accessory manager (OAM).

* * * * *